US005287846A

United States Patent [19]

Capjon et al.

[11] Patent Number: 5,287,846

[45] Date of Patent: Feb. 22, 1994

[54] RESUSCITATION DEVICE

[75] Inventors: Jan Capjon, Fagerstrand; Atle Nygaardsvik, Fjellstrand, both of Norway

[73] Assignee: Medreco A.S., Oslo, Norway

[21] Appl. No.: 958,330

[22] PCT Filed: May 22, 1991

[86] PCT No.: PCT/NO91/00073

§ 371 Date: Feb. 8, 1993

§ 102(e) Date: Feb. 8, 1993

[87] PCT Pub. No.: WO91/19473

PCT Pub. Date: Dec. 26, 1991

[30] Foreign Application Priority Data

Jun. 12, 1990 [NO] Norway ..... 902615

[51] Int. Cl.[5] ..... A61H 31/00

[52] U.S. Cl. ..... 128/28; 128/30.2

[58] Field of Search ..... 128/28, 30, 30.2

[56] References Cited

U.S. PATENT DOCUMENTS

| | | | |
|---|---|---|---|
| 2,484,306 | 10/1949 | McClain et al. | 128/28 |
| 3,219,031 | 11/1965 | Rentsch, Jr. | 128/28 |
| 3,509,899 | 5/1970 | Hewson | 128/28 |
| 3,896,797 | 7/1975 | Bocur | 128/28 |
| 3,965,893 | 6/1976 | Ragailler | 128/28 |
| 4,060,079 | 11/1977 | Reinhold, Jr. | 128/30.2 |
| 4,397,306 | 8/1983 | Weisfeldt et al. | 128/28 |
| 4,664,098 | 5/1987 | Woudenberg et al. | 128/30.2 |
| 4,702,231 | 10/1987 | Ardin | 128/28 |
| 4,770,164 | 9/1988 | Lach et al. | 128/28 |

*Primary Examiner*—Richard J. Apley
*Assistant Examiner*—Lynne A. Reichard
*Attorney, Agent, or Firm*—Cohen, Pontani, Lieberman, Pavane

[57] ABSTRACT

A resuscitation device having a specific frame design with an integrated hydraulic plunger frame which is adapted to be strapped over a patient's chest. The frame is designed with two protruding arms stretching towards the patient's armpits. The frame includes flexible straps coiled onto spring biased rotatable reels. The straps end in respective armpit stays which are looked into recesses in a back support. The plunger of the frame stops against a limiting means which limits the travel of the plunger automatically according to the size of the patient's chest.

23 Claims, 2 Drawing Sheets

RESUSCITATION DEVICE

Figure 1:
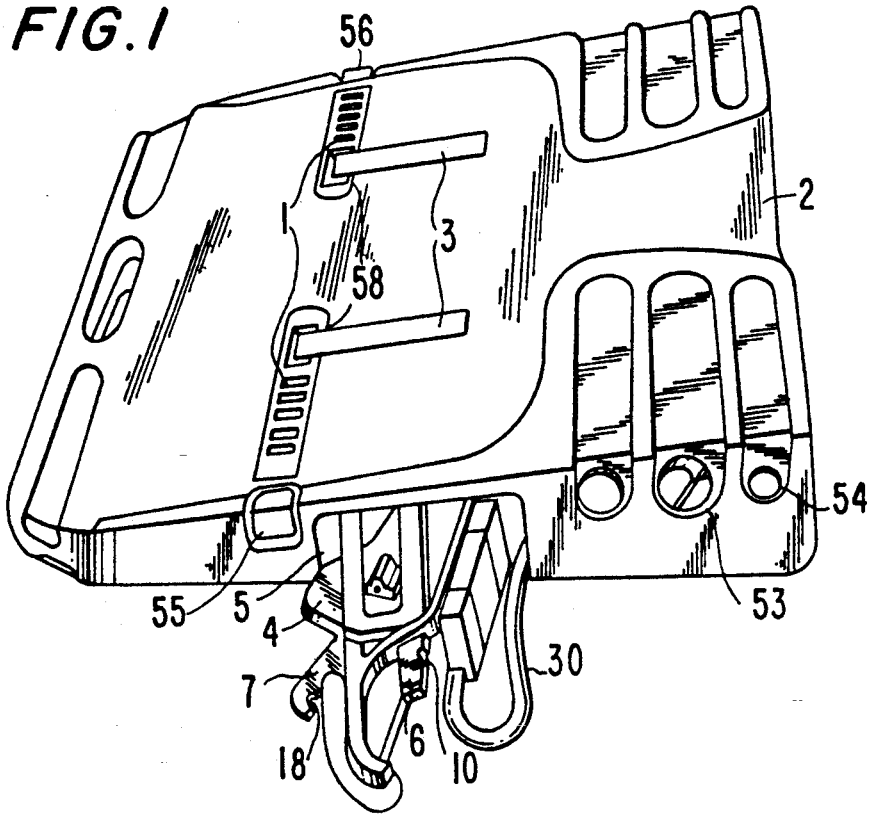

This invention relates to a device for resuscitation of patients with cardiac arrest by providing an external pulsating mechanical pressure on the patient's sternum.

During such a resuscitation process the patient is unconscious. Usually manual heart massage is undertaken as the chest is depressed manually by applying the hand with great force (up to 70 kp) in short-lasting pushes having a frequency of approximately 100 depressions per minute. This process often has to be undertaken under difficult conditions and in critical circumstances. During optimal conditions such heart massage can scarcely keep the patient alive, but optimal conditions very seldom exist during transport by ambulance. Transport on a stretcher to and from the ambulance, often on staircases, is critical as well. During a prolonged revival process the physical stamina of the personnel is in addition usually limited. Recent research reports recommend both increased frequency and increased pressure compared with earlier recommendations. Manual heart massage is going to be insufficient related to the new recommendations, and this fact increases the requirements for mechanical massage.

Earlier, many different types of pneumatic devices for automatic operation were developed and patented. Examples are to be found in designs shown in Norwegian patents Nos. 109.274 and 133.827, Swedish patent applications Nos 763389-1, 7712019.2, British patent Nos. 1.40.581 and 1.492.105 as well U.S. Pat. Nos. 4,702,231, 3,461,858 and 3,351,052. Further, an American pneumatic heart massage apparatus produced by Michigan Instruments Inc., is available. All those devices use pressure-cylinders to provide the mechanical power. These cylinders are fixed either by straps and equipped with a rigid, non-flexible cylinder holder intruding from the one side, or have an adjustable arched frame arranged over the patient's thorax. The devices are designed for installation on a stretcher and they are provided with a thick back support to keep the patient in a correct position, chest upwards and head downwards and backwards.

During practical use these devices do not function satisfactorily. This is not necessarily due to bad technical operation but to poor user qualities. This conclusion has been reached after interviews with ambulance staff who had tested different brands. Only one of the types, the American model, is available on the market, but only a few such devices have been sold in Norway in spite of a remarkable need here on account of the long transport distances in fringe areas. The most common problems are heavy weight and awkward shapes and dimensions, e.g. the device protrudes from the one side of the stretcher. Great weight cannot be avoided if a pneumatic solution is used, as the cylinders require compressed air which has to be provided by means of heavy gas containers which must be carried along during transportation by stretcher to the ambulance. The above mentioned American apparatus weighs 32 kilos when operational.

An important demand is that the equipment has to be very flexible. In practice one does not know whether the patient needs heart massage or not until one has been on the scene of the accident, which may be far away from the ambulance (e.g. many storeys up in a block of flats). Thus the equipment always has to be taken along when use may be anticipated, although there may be a large risk that it will not be needed. The equipment therefor has to be easily portable to be practical for use at a distance from the ambulance. In addition it must be easy to stow away in a confined ambulance. Further, another practical problem has arisen which has resulted in great difficulties for the user. If the patient is moved in relation to the plunger great damage may occur, for instance compression of the diaphragm, broken ribs etc. If the pressure cylinder/-plunger is rigidly joined to the back support, practical use has shown that a change of position may occur even when the patient is strapped to the equipment with straps or belts. In some of the solutions the pressure cylinder is connected to the back support by means of straps pressing down on the patient's chest. Then some of the displacement problem is avoided, but slanting straps over the chest represent a bad solution, as the oblique components of the stretch in the straps makes the straps to cut into the chest, and stretch vertically under the pressure period Such solutions therefore represent an unstable (vertically elastic) fixture for the pressure cylinder.

The present invention has been obtained as a result of a close study of the operational requirements, as described above. Various different solutions have been tested in cooperation with doctors and ambulance personnel. The new and characterizing features of the invention comprise a combination of a particular frame and the design which integrates this frane with the back support by means of two particularly designed armpit stays By means of the integrated design of the frame and the fastening devices according to this invention, it is first obtained that the patient is orientated in a correct position in relation to the support and the plunger independent of the patient's size, and secondly the patient is strapped down in a definite position, but with a minimum of straps, and in such a manner that he cannot be displaced during transport (for instance on staircases), and further that the pressure cylinder is secured in a stable position without vertical deformation due to pressure, and finally the selection of component arrangements, the design of the details and the combination of such features are undertaken in such a manner that the device functions conveniently in use, and the components may be conveniently stowed away as one compact unit which is easily portable In addition there is obtained, by means of a specific connection, an automatic delimiting of the plunger travel as a function of the chest size.

All the features mentioned above are brought about by the two above-mentioned armpit stays being fastened to strops which may be coiled up and stored in the frame above the patient's chest. The armpit stays are arranged close to the patient's chest and are locked by means of automatic snap-in catches in corresponding recesses in the back support close to the armpit of the patient. Independent of the size of the patient, the plunger will now be situated in a correct position on the sternum as this is always in line with the armpits. The fastening of the patient to the stays is now undertaken by means of two straps attached to the support being hooked onto the frame and then tightened. The retractable straps are then almost vertically guided into grooves in the protruding arms of the frame to obtain a substantially vertical stretch in the straps, not leading to noticeable oblique components in this stretch, which in turn would result in a corresponding elasticity in the vertical direction. Each of the straps runs in a respective groove in the frame to a corresponding spring pretensioned coiling reel within the frame. The spring tension results in an automatic adaption to the chest size in question, and at the same time the straps are out of the way when the equipment is packed away. When the reels are locked by means of a corresponding lever on the back of the frame, the frame is correctly adjusted to the patient. The plunger is rigidly connected to a hydraulic cylinder arranged in the center of the frame. This plunger stops against a stopper which is moveable by means of a wire arrangement connected to one of the reels, and this arrangement automatically limits the travel of the plunger, depending on the size of the chest. Due to this design, ribs should not be broken by means of a too lengthy travel by the plunger. Further, the frame is connected to an electro-hydraulic aggregate within the back support by means of a flexible hydraulic hose. This hose is placed in the back support in a corresponding recess when stowed away. In a corresponding manner the armpit stays are placed in corresponding recesses in the frame before the frame unit is placed in an opening in the back support. The straps are placed in corresponding openings on the support, and the unit then makes up an easily portable suitcase adapted to the requirements mentioned above.

Figure 2:
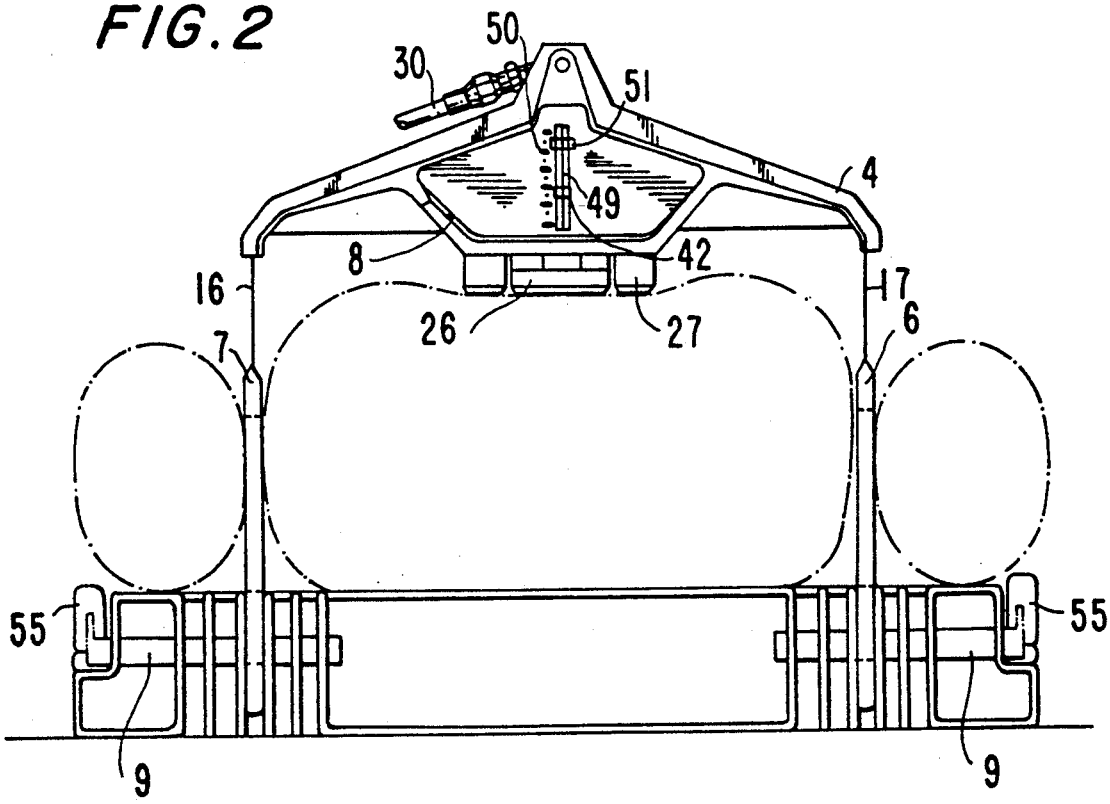
Figure 3:
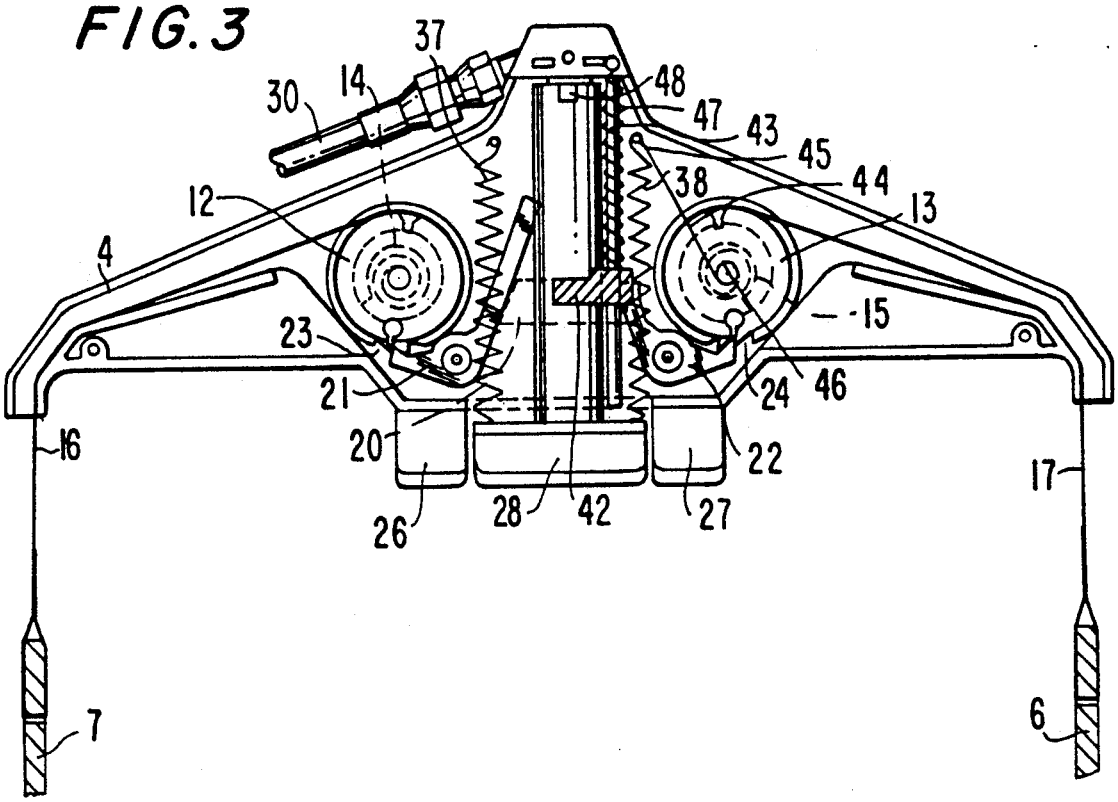
Figure 4:
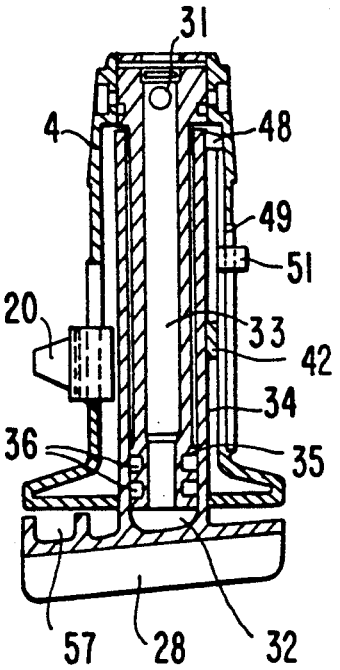
Figure 5:
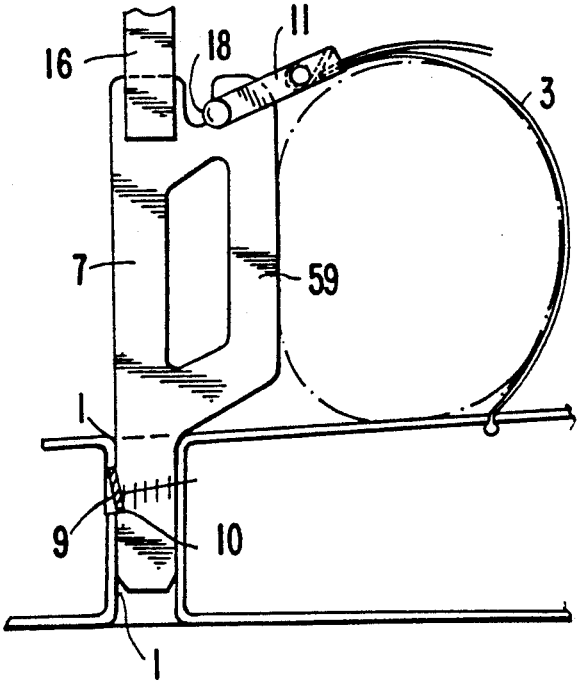

Further distinctive features and advantages of the equipment according to this invention will be understood from the following description and the accompanying drawings where:

FIG. 1 illustrates a suitcase/support unit with a folded frame partly in its storing recess, FIG. 2 illustrates the frame fastened to the patient's chest, shown in cross section, FIG. 3 illustrates the interior of the frame, FIG. 4 illustrates a cross section through the center of the frame, and FIG. 5 illustrates an armpit stay attached to the back support.

The patient is laid on the back support with his armpits just above the rows of holes 1 or recesses and with his head in the depression 2. The fastening straps 3 are arranged loosely and backwards. Then, the stowed away frame unit including the frame 4 is taken out from its storage and strapped over the patient's chest as shown in FIG. 2. The armpit stays 6 and 7, which are arranged on the stowed away frame in grooves 8, are taken out and are entered into the recesses in the rows 1 corresponding to the chest size in question, and depressed so far that the snap lock 9 is fastened in corresponding locking indentations 10 in the armpit stays 6, 7. The reels 12, 13 in FIG. 3 are spring operated as shown by 14, 15 and automatically give correct pretension in the straps 16, 17. When the locking lever 20 on the back of the frame is pressed downwards, the spring tensioned locking hatches 21, 22 intrude into sprockets 23, 24 in the reels (arranged around the periphery) and lock the straps in the correct position corresponding to the chest size. The frame is now ready for use. Before starting the resuscitation process the patient is placed securely against the armpit stays 6, 7 which are now fastened to the back support and the straps are tightened when the straps 3 are attached by means of brackets 11 to recesses 18 in the armpit stays. The contact cushions 26, 27 support the frame against the patient's chest when the plunger 28 is in its withdrawn position before start. When reciprocating oil exposed to pressure from the hydraulic aggregate within the support enters the pressure cylinder via the hydraulic hose 30 and the opening 31, it reaches the pressure chamber 32 of the plunger via the space 33 in the piston rod 34 (rigidly connected to the frame 4) and the plunger 35 with its pad 28 reciprocates (ref. FIG. 4). Packing 36 provides tight connection. The springs 37, 38 add withdrawal force for pulling the plunger backwards again (in addition to the reactive force from the patient's chest).

To avoid damage due to too great a force acting on small and fragile chests, a limiting device which bars the travel of the plunger is provided. The shoulder 42 travels in accordance with the movement of the reel 13 by means of a thin steel wire 44 which passes, via a pulley 45, to a coil-up cylinder 46. The shoulder 42 moves up and down along a pole 43.

A spring arranged around the pole 43 presses the stopper 42 downwards to keep the wire tight When the strap 17 is pulled out of the frame to give room for a large sized chest, the stopper 42 moves downwards accordingly along the pole 43 as the direction of the wire on the cylinder 46 are opposite of the direction of the strap 17. The delimiting of the plunger travel is obtained as the piston 35 is provided with a small shoulder 48 on the top, and this shoulder locks towards a tongue on the stopper 42 if the piston tends to travel too far in relation to the chest size in question (for instance when the sternum is broken). Because of this action the shoulder locks towards the pole due to the geometry of the shoulder (the acting force from the piston acts on a long arm while the resulting, reactive force towards the pole acts on a short lever arm). The correlation between chosen plunger travel limit and different chest sizes is dependant on the diameter of the cylinder 46 and is again determined by experimental data.

FIG. 2 illustrates a side view of the frame. Through the opening 49 in the frame the plunger travel delimiting arrangement 42 is seen, and the limited travel value may be read from the scale 50. A spring loaded arrow 51 moves in the opening 49. At the start this arrow is situated uppermost. As the force increases the shoulder 48 on the plunger will push the arrow downwards for each travel, and the length of travel then may be read for each pulsation from the scale 50.

All equipment required to operate the device is kept within the back support. The hydraulic aggregate provides the correct, pulsating oil pressure The frequency is set separately. The on/off control and the pressure is controlled by means of a switch 53. In addition there is a stopping key 54 for pausing purposes. The aggregate is fed by a DC-motor which is driven by means of a 12 V accumulator or via the mains and a built-in power supply. The AC-cord with its connector is connected to a wind-up reel. In addition the unit has a power supply terminal for direct current supply from the ambulance or helicopter. All those components are not separately shown as they do not represent the main features of this patent.

When the frame is to be attached, the armpit stays are released from their locked positions by means of releasing knobs 55, 56 on each side of the rows of recesses 1. The frame is removed and the armpit stays 6, 7 entered in corresponding grooves 8 before the frame with the hydraulic hose 30 arranged in a corresponding groove 57 in the plunger is put back in the storage opening 5. Fastening straps 3 are retracted and arranged in the openings 58. A small and light unit which may easily be transported and which in addition meets the functional demands mentioned above has been now been achieved.

The complete unit including batteries for approximately 30 minutes operation has a weight of about 10 kg. The frame, the support, the armpit stays and many of the remaining elements are cast in plastics. The prototype has been developed and tested in cooperation with ambulance personnel to obtain optimal functional solutions. The unit as described above acts very satisfactorily during practical use—which is not the case with earlier designs described in patents mentioned above.

The resuscitation device in accordance with the present invention may have various different designs without leaving the scope of the present invention.

Although a hydraulic solution is most thoroughly discussed, in which the power source comprises one battery, an electric motor and a hydraulic pump, all built into the body of the back support, there is nothing to prevent an electro-mechanical or a pneumatic solution being used, although the components presently available, both when weight and efficiency are considered, seem to give preference to an electro-hydraulic solution. Further the scale which gives the readings of the plunger travelling may be moved from the frame to the back support without leaving the scope of the present invention. Finally it is possible to use more straps for fastening the resuscitation device to the patient than shown in the examples.

It has also to be mentioned that even if the detection of the length of the straps being in active use, and all further use of these detected values to control the limitation of the plunger travelling is obtained by means of mechanical means only, every use of electronic, electromechanical or possibly optical elements and components to provide such detecting and control will also be within the scope of the present invention.

We claim:

1. Resuscitation device, in particular for resuscitation of a patient with cardiac arrest, which device comprises a frame provided with at least one plunger which, when acted upon by a force generating means will move a plunger pad to and from the chest of a patient, an underlying back support means on which the patient may rest, as well as fastening means to attach the frame to the support means so that the patient is positioned between same, characterized in that the fastening means comprises flexible but substantially non-stretchable straps (16,17) each coiled up on a spring biased rotatable reel (12,13) each of which may be locked in different angular positions, which straps (16,17) are ending in, or are connected to, respectively arranged armpit stays (6,7) each of which is provided with a protruding edge or has an adapted width relative to the other dimensions of the resuscitation device to ensure that the plunger pad (28) will be pressed against the correct place on the sternum, independent of the size of the patient, when the resuscitation device is strapped around the patient with the armpit stays arranged in his armpits.

2. Resuscitation device in accordance with claim 1, characterized in that the rotating reels (12, 13) are arranged symmetrically in the frame (4) which are provided with protruding arms towards the armpits of the patient, that the back support is provided with at least one set of symmetrically arranged fastening means (1) designed to correspond with the free end of the armpit stays (6,7) so that each of the armpit stays (6,7) may be pushed into one of the fastening means (1) selected close to the patient, and by snap-action being secured to this selected fastening means.

3. Resuscitation device according to claim 1, characterized in that the active length of the straps (16,17) pulled out from the rotating reels (12, 14) are detected or registered, that the plunger is provided with a limiting device (42,43,47) to delimit the travel of the plunger, and that it additionally is provided with a controlling means (12,13: 21,22: 42,43,44,45,46,47,48) which makes the limitation of the plunger travel dependent on the active length of the straps and also cf the size of the patient's chest, in such a manner that the travel of the plunger becomes shorter the shorter the lengths of straps taken into use.

4. Resuscitation device according to claim 1, characterized in that the rotatable reels (12, 13) are provided with a sprocket wheel (23,24) and a corresponding pawl (21,22) by means of which the spring biased rotatable reels may be locked in a desired position by operating the pawls, for instance by means of a locking hatch (20).

5. Resuscitation device according to claim 2, characterized in that the fastening means (1) which is arranged in the underlying back support is designed as a row of recesses into which the end of the armpit stays (6,7) fit, and a common spring biased snap-lock (9) for each set of recesses, where each snap-lock is provided with a releasing knob (55,56) on the outside of the support.

6. Resuscitation device according to claim 1, characterized in that the power generating means is an hydraulic cylinder in which the internal piston rod (34) is rigidly connected to the frame (4) at its center while the enclosing hydraulic piston (35) is rigidly fastened to the plunger pad (28) and during operation reciprocates up and down as the mobile part of the hydraulic cylinder.

7. Resuscitation device according to claim 1, characterized in that the limiting device used to delimit the travel of the plunger comprises a stopper (42) reciprocating on a pole (43) and has a stopper reaching into the trajectory of the plunger (35), and that the position of the stopper is determined by the current active length of the straps (16,17) which again is determined by the size of the patient's chest.

8. Resuscitation device according to claim 7, characterized in that the limiting means is controlled by a steel wire (44) coiled up on the same rotatable reel (46 on 13) as one of the straps but in opposite direction.

9. Resuscitation device according to claim 1, characterized in that the control device comprises a sensor which detects how much of the straps are taken into active use and that the detected value is used to control the limitation of the travelling of the plunger by means of electronic, electromechanical or possibly optical components.

10. Resuscitation device according to claim 2, characterized in that the active length of the straps (16, 17) pulled out from the rotating reels (12, 14) are detected or registered, that the plunger is provided with a limiting device (42, 43, 47) to delimit the travel of the plunger, and that it additionally is provided with a controlling means (12,13: 21,22: 42, 43, 44, 45, 46, 47, 48) which makes the limitation of the plunger travel dependent on the active length of the straps and also of the size of the patient's chest, in such a manner that the travel of the plunger becomes shorter the shorter the lengths of straps taken into use.

11. Resuscitation device according to claim 2, characterized in that the rotatable reels (12, 13) are provided with a sprocket wheel (23, 24) and a corresponding pawl (21, 22) by means of which the spring biased rotatable reels may be locked in a desired position by operating the pawls, for instance by means of a locking hatch (20).

12. Resuscitation device according to claim 3, characterized in that the rotatable reels (12, 13) are provided with a sprocket wheel (23, 24) and a corresponding pawl (21, 22) by means of which the spring biased rotatable reels may be locked in a desired position by operating the pawls, for instance by means of a locking hatch (20).

13. Resuscitation device according to claim 3, characterized in that the fastening means (1) which is arranged in the underlying back support is designed as a row of recesses into which the end of the armpit stays (6, 7) fit, and a common spring biased snap-lock (9) for each set of recesses, where each snap-lock is provided with a releasing knob (55, 56) on the outside of the support.

14. Resuscitation device according to claim 4, characterized in that the fastening means (1) which is arranged in the underlying back support is designed as a row of recesses into which the end of the armpit stays (6, 7) fit, and a common spring biased snap-lock (9) for each set of recesses, where each snap-lock is provided with a releasing knob (55, 56) on the outside of the support.

15. Resuscitation device according to claim 2, characterized in that the power generating means is an hydraulic cylinder in which the internal piston rod (34) is rigidly connected to the frame (4) at its center while the enclosing hydraulic piston (35) is rigidly fastened to the plunger pad (28) and during operation reciprocates up and down as the mobile part of the hydraulic cylinder.

16. Resuscitation device according to claim 3, characterized in that the power generating means is an hydraulic cylinder in which the internal piston rod (34) is rigidly connected to the frame (4) at its center while the enclosing hydraulic piston (35) is rigidly fastened to the plunger pad (28) and during operation reciprocates up and down as the mobile part of the hydraulic cylinder.

17. Resuscitation device according to claim 4, characterized in that the power generating means is an hydraulic cylinder in which the internal piston rod (34) is rigidly connected to the frame (4) at its center while the enclosing hydraulic piston (35) is rigidly fastened to the plunger pad (28) and during operation reciprocates up and down as the mobile part of the hydraulic cylinder.

18. Resuscitation device according to claim 5, characterized in that the power generating means is an hydraulic cylinder in which the internal piston rod (34) is rigidly connected to the frame (4) at its center while the enclosing hydraulic piston (35) is rigidly fastened to the plunger pad (28) and during operation reciprocates up and down as the mobile part of the hydraulic cylinder.

19. Resuscitation device according to claim 2, characterized in that the limiting device used to delimit the travel of the plunger comprises a stopper (42) reciprocating on a pole (43) and has a stopper reaching into the trajectory of the plunger (35), and that the position of the stopper is determined by the current active length of the straps (16, 17) which again is determined by the size of the patient's chest.

20. Resuscitation device according to claim 3, characterized in that the limiting device used to delimit the travel of the plunger comprises a stopper (42) reciprocating on a pole (43) and has a stopper reaching into the trajectory of the plunger (35), and that the position of the stopper is determined by the current active length of the straps (16, 17) which again is determined by the size of the patient's chest.

21. Resuscitation device according to claim 4, characterized in that the limiting device used to delimit the travel of the plunger comprises a stopper (42) reciprocating on a pole (43) and has a stopper reaching into the trajectory of the plunger (35), and that the position of the stopper is determined by the current active length of the straps (16, 17) which again is determined by the size of the patient's chest.

22. Resuscitation device according to claim 5, characterized in that the limiting device used to delimit the travel of the plunger comprises a stopper (42) reciprocating on a pole (43) and has a stopper reaching into the trajectory of the plunger (35), and that the position of the stopper is determined by the current active length of the straps (16, 17) which again is determined by the size of the patient'chest.

23. Resuscitation device according to claim 6, characterized in that the limiting device used to delimit the travel of the plunger comprises a stopper (42) reciprocating on a pole (43) and has a stopper reaching into the trajectory of the plunger (35), and that the position of the stopper is determined by the current active length of the straps (16, 17) which again is determined by the size of the patient's chest.

* * * * *